US009375086B2

(12) United States Patent
Brandt et al.

(10) Patent No.: US 9,375,086 B2
(45) Date of Patent: Jun. 28, 2016

(54) REMOVABLE CORNER GUARD FOR CONTROL TABLES OR TOOL BOXES

(71) Applicant: WILLIAM FRICK & COMPANY, Libertyville, IL (US)

(72) Inventors: Jeffrey H. Brandt, Libertyville, IL (US); Chad E. Svastisalee, Chicago, IL (US); Suraj Prakash, Hainsville, IL (US)

(73) Assignee: WILLIAM FRICK & COMPANY, Libertyville, IL (US)

( * ) Notice: Subject to any disclaimer, the term of this patent is extended or adjusted under 35 U.S.C. 154(b) by 18 days.

(21) Appl. No.: 14/491,089

(22) Filed: Sep. 19, 2014

(65) Prior Publication Data

US 2015/0076305 A1 Mar. 19, 2015

Related U.S. Application Data

(60) Provisional application No. 61/879,734, filed on Sep. 19, 2013.

(51) Int. Cl.

| | |
|---|---|
| ***A47B 95/04*** | (2006.01) |
| ***B25H 3/02*** | (2006.01) |
| ***A47B 96/00*** | (2006.01) |
| ***A47B 13/08*** | (2006.01) |

(52) U.S. Cl.

CPC ..... *A47B 95/043* (2013.01); *A47B 13/08* (2013.01); *A47B 96/00* (2013.01); *B25H 3/02* (2013.01)

(58) Field of Classification Search

CPC ..... A47B 95/043; A47B 2095/046; A47B 13/083; A47B 2013/085; A47B 13/08; A47B 96/00; B62B 5/0006; B62B 5/0009; Y10T 428/24017; Y10T 428/24174; B25H 3/02

USPC ..... 248/345.1, 690, 615, 220.22, 225.21, 248/339, 340, 322; 108/27; 280/33.992, 280/47.41, 47.29; 52/716.3, 716.4, 52/718.04–718.06, 287.1, 288.1, 716.1; 211/183, 191; 312/137, 140.1, 140.4; 206/453, 586

See application file for complete search history.

(56) References Cited

U.S. PATENT DOCUMENTS

| | | | | | |
|---|---|---|---|---|---|
| 2,110,005 | A * | 3/1938 | Rees | F24C 15/08 16/19 |
| 4,055,362 | A * | 10/1977 | Becker, III | B62B 5/0006 293/121 |
| 4,161,853 | A * | 7/1979 | Weiss | E04F 19/028 52/254 |

(Continued)

FOREIGN PATENT DOCUMENTS

| | | | | |
|---|---|---|---|---|
| CN | 201509841 U | * | 6/2010 | |
| FR | 1398888 A | * | 5/1965 | A47B 95/043 |
| GB | 2200836 A | * | 8/1988 | A47B 95/043 |

*Primary Examiner* — Jonathan Liu
*Assistant Examiner* — Guang H Guan
(74) *Attorney, Agent, or Firm* — Justin Lampei

(57) ABSTRACT

A removable corner guard is provided. The removable corner guard is especially suitable for protecting the corners of, for example, control tables or tool boxes from deformations and from scratches. Further, the corner guard may be used as decorative addition to an otherwise plain control table or tool box. The device has a semi-rigid rubber housing which covers securing anchors having an internal skeleton. An extended ridge on a lower end of the corner guard locks the corner guard at the lower end of the edge of the control table. The corner guard may be adjusted to fit control tables or tool boxes of various sizes. A non-slip textured exterior surface may allow for the device to be easily transported.

9 Claims, 3 Drawing Sheets

(56) References Cited

U.S. PATENT DOCUMENTS 4,292,901 A * 10/1981 Cox ..... B65D 71/0096 108/55.1
4,810,550 A * 3/1989 Gasser ..... A47B 13/083 248/345.1
4,971,849 A * 11/1990 Azzar ..... A47B 13/083 248/345.1
5,004,198 A * 4/1991 Jager ..... A47F 5/106 248/224.8
5,026,588 A * 6/1991 Diekmann ..... A47B 95/043 248/345.1
5,033,244 A * 7/1991 Ullman ..... A47B 95/043 52/288.1
5,115,917 A * 5/1992 Schrage ..... B65D 11/22 108/55.1
5,131,669 A * 7/1992 Kinnamon ..... B62B 5/0006 280/33.992
5,238,256 A * 8/1993 Ondrasik ..... B62B 5/0006 280/33.991
5,322,257 A * 6/1994 Verderose ..... A47B 91/00 248/205.3
5,584,623 A * 12/1996 Nadherny ..... B65D 71/04 410/155
5,603,140 A * 2/1997 Pryce ..... A47B 91/00 16/18 CG
5,772,037 A * 6/1998 Hurley ..... B65D 81/054 206/586
5,775,045 A * 7/1998 Hill ..... E04G 21/30 49/57
5,934,623 A * 8/1999 Kopish ..... A47B 21/06 248/65
6,179,354 B1 * 1/2001 Bennett, Jr. ..... B60R 19/42 293/128
6,214,436 B1 * 4/2001 Catta ..... A47B 95/043 108/27
6,299,118 B1 * 10/2001 Farrell ..... A47G 7/047 248/317
6,354,049 B1 * 3/2002 Bennett ..... E04F 19/028 52/287.1
D464,558 S * 10/2002 Trifilio ..... D8/354
6,748,716 B1 * 6/2004 Peck, Jr. ..... E04F 19/026 293/136
7,281,719 B2 * 10/2007 O'Quin ..... B62B 5/0006 280/33.991
7,296,808 B2 * 11/2007 Huguet ..... A47B 95/043 280/47.34
7,810,654 B1 * 10/2010 Wang ..... A47F 5/0006 211/106.01
8,267,262 B2 * 9/2012 Thelwell ..... A47B 95/043 211/183
8,371,081 B2 * 2/2013 Bennett ..... E04F 19/028 52/255
8,572,915 B2 * 11/2013 Meahl ..... E04F 19/04 52/287.1
8,783,476 B2 * 7/2014 Woodley ..... A47F 5/105 211/183
2009/0189045 A1 * 7/2009 Peckovich ..... A47B 95/043 248/345.1
2009/0239005 A1 * 9/2009 Hawkins ..... A47B 95/043 428/34.1
2015/0076305 A1 * 3/2015 Brandt ..... B25H 3/02 248/345.1

* cited by examiner

REMOVABLE CORNER GUARD FOR CONTROL TABLES OR TOOL BOXES

CROSS REFERENCE TO RELATED APPLICATIONS

The following application is based on and claims the priority benefit of U.S. provisional application Ser. No. 61/879,734 filed Sep. 19, 2013; the entire contents of which are incorporated by reference.

BACKGROUND OF THE INVENTION

A removable corner guard is provided. The removable corner guard is especially suitable for protecting the corners of, for example, control tables or tool boxes from deformations and from scratches. Further, the corner guard may be used as decorative addition to an otherwise plain control table or tool box. The device has a semi-rigid rubber housing which covers securing anchors having an internal skeleton. An extended ridge on a lower end of the corner guard locks the corner guard at the lower end of the edge of the control table. The corner guard may be adjusted to fit control tables or tool boxes of various sizes. The extended ridge of the lower end may first be secured to the lower end of the control table or tool box and then the top end of the corner guard may rest on the top end of the control table or tool box by a tab. A non-slip textured exterior surface may allow for the device to be easily transported.

Over the years, attempts have been made to provide guards for corners of structures. For example, U.S. Pat. No. 8,371,081 to Bennett et al. discloses a wall guard for use around wall corners in which the wall guard has a pair of retainers which are flexibly mounted to one another. The retainers are coupled to one another by way of an adhesive tape material that extends over the back sides of the retainers. A cover is secured to the pair of retainers for absorbing impacts from passing traffic to thereby protect the corner of the wall against wear and tear.

Further, U.S. Pat. No. 7,587,790 to McCue discloses a wall guard for use around wall corners in which the wall guard has a pair of retainers that are flexibly mounted to one another. The retainers are coupled to one another by way of an adhesive tape material that extends over the back sides of the retainers. A cover is secured to the pair of retainers for absorbing impacts from passing traffic to thereby protect the corner of the wall against wear and tear.

Still further, U.S. Pat. No. 6,125,488 to Vogland discloses a corner guard configured to attach to and protect the corner of a mattress foundation, as well as to receive selected ornamentation. The corner guard includes an impact-resistant core and a cover that overlies at least at portion of the core. In one embodiment of the invention, the cover is constructed of fabric and may be ornamented with patterns or indicia by a variety of techniques. The cover ensures that the ornamentation will not be damaged even if the corner guard must be bent to match the shape of the mattress foundation. Optionally, a foam layer may be positioned between the core and the cover to impart a quilted texture and appearance to the corner guard, and to provide additional padding for the mattress foundation.

However, these patents fail to describe a corner guard for a control table or tool box which is easy to use and efficient as is described in the present application. Further, these patents fail to provide a corner guard which has an internal skeleton for securing an anchor to a control table.

SUMMARY OF THE INVENTION

A removable corner guard is provided. The removable corner guard is especially suitable for protecting the corners of, for example, control tables or tool boxes from deformations and from scratches. Further, the corner guard may be used as decorative addition to an otherwise plain control table or tool box. The device has a semi-rigid rubber housing which covers securing anchors having an internal skeleton. An extended ridge on a lower end of the corner guard locks the corner guard at the lower end of the edge of the control table. The corner guard may be adjusted to fit control tables or tool boxes of various sizes. The extended ridge of the lower end may first be secured to the lower end of the control table or tool box and then the top end of the corner guard may rest on the top end of the control table or tool box by a tab. A non-slip textured exterior surface may allow for the device to be easily transported.

An advantage of the present corner guard is that the present corner guard may have various durometer measurements so as to provide a guard of various stiffness levels.

A further advantage of the present corner guard is that the present corner guard may have various indicia (or artwork) located on a main body section to illustrate a logo or other desired illustration or information.

Yet another advantage of the present corner guard is that the present corner guard may protect a control table or tool box.

And another advantage of the present corner guard is that the present corner guard may have a non-slip textured exterior surface to prevent slippage.

Still another advantage of the present corner guard is that the present corner guard may have a tab portion which is partially inserted within a main body section wherein the tab portion has extensions which may accommodate increased tension forces.

And another advantage of the present corner guard is that the present corner guard may be reused on various control tables.

Still another advantage of the present corner guard is that the present corner guard may be placed on or removed from a control table or tool box very quickly.

For a more complete understanding of the above listed features and advantages of the present corner guard reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A removable corner guard is provided. The removable corner guard is especially suitable for protecting the corners of, for example, control tables or tool boxes from deformations and from scratches. Further, the corner guard may be used as decorative addition to an otherwise plain control table or tool box. The device has a semi-rigid rubber housing which covers securing anchors having an internal skeleton. An extended ridge on a lower end of the corner guard locks the corner guard at the lower end of the edge of the control table. The corner guard may be adjusted to fit control tables or tool boxes of various sizes. The extended ridge of the lower end may first be secured to the lower end of the control table or tool box and then the top end of the corner guard may rest on the top end of the control table or tool box by a tab. A non-slip textured exterior surface may allow for the device to be easily transported.

Figure 12:
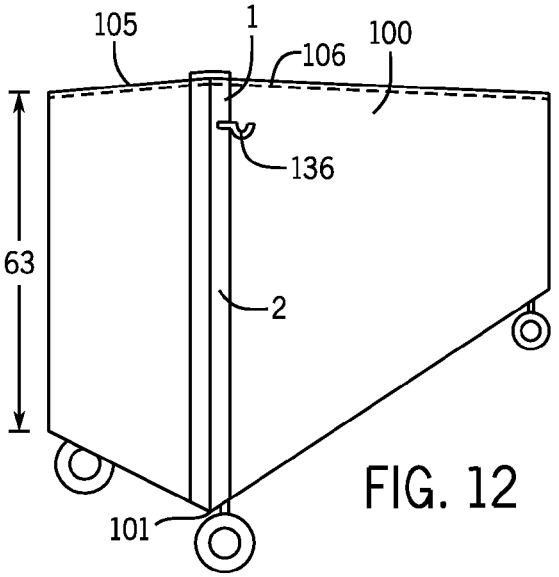
FIG. 12 illustrates a perspective view of the corner guard installed on a control table or tool box.
Figure 14:
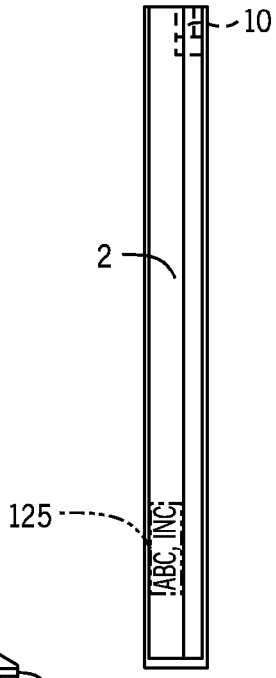
FIG. 14 illustrates a side front view of the corner guard having indicia or another illustration printed thereon.
Figure 15:
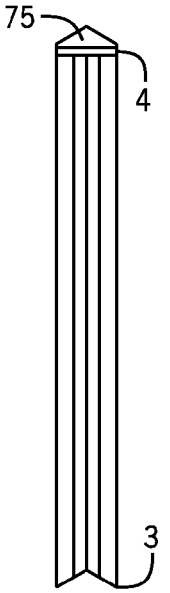
FIG. 15 illustrates a view of the corner guard wherein the removable cap is secured on the bottom of the main body.

Referring now to the drawings, a corner guard 1 for a control table 100 (FIG. 12) is provided. Preferably, a corner guard 1 is used for each corner of a control table or tool box 100. In an embodiment, the corner guard 1 may be generally constructed of rubber and metal and in an embodiment, the corner guard 1 may have a glow-in-the-dark or fluorescent paint exterior to increase visibility in diminished lighting. In particular, the device 1 may be constructed of a specialized rubber (such as polychloroprene or neoprene) with a specific durometer to suit a particular stiffness needed for a specific control table 100 (or tool box); the higher the durometer resulting in the higher the stiffness. In particular, the greater stiffness the better the corner guard 1 will fit snugly on the control table 100. It should be understood that the device 1 may be constructed of any suitable material. In an embodiment, the corner guard 1 may have indicia (or art) 125 (FIG. 14) on the exterior surface of the body 2. As illustrated in 7, the corner guard 1 may be generally "L-shaped" so that the device 1 may be snugly placed over a corner of the control table 100.

Figure 13:
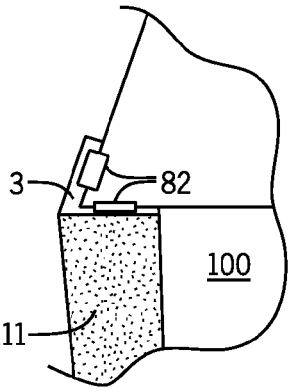
FIG. 13 illustrates a top perspective view of the corner guard installed on a control table or tool box.

In an embodiment, the corner guard 1 may have a plurality of small bumps 111 (FIG. 13) creating a generally rough textured exterior surface. In an alternative embodiment, a plurality of small bumps 111 may also be present on the interior surface of the corner guard (See FIG. 5B). The plurality of small bumps 111 may reduce the chances of the device 1 (and the attached control table 100) from slipping during use of the control table 100 or during transportation of the control table 100.

Figure 10:
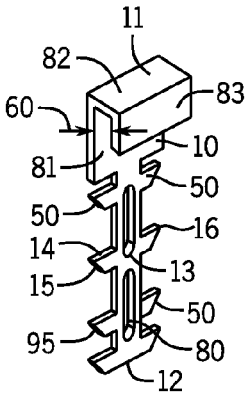
FIG. 10 illustrates a perspective view of the corner guard tab.

Referring now to FIGS. 1-6, in an embodiment, the corner guard 1 may have a main body portion 2 and at least one tab portion 10. The main body portion 2 may have a top 3, a bottom 4, a front 5, a back 6 (FIG. 4), a first side 7 and a second side 8. The tab portion 10 may have a top 11 (FIG. 10), a bottom 12, a front 13, a back 14, a first side 15 and a second side 16. Preferably, two tab portions 10 are secured to the top 3 of the main body portion 2, one on the first side 7 and one on the second side 8; however, alternative embodiments may have one tab 10 or more than two tabs 10.

Figure 6:
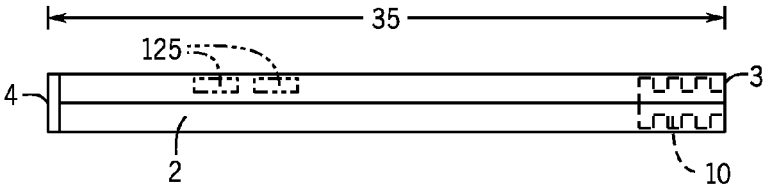
FIG. 6 illustrates a front view of the corner guard wherein the tab portion is illustrated in phantom partially within the main body portion of the corner guard.
Figure 9A:
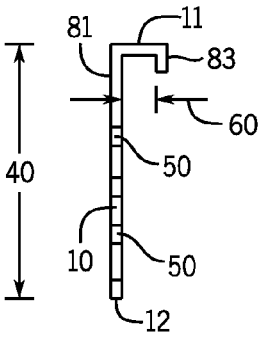
FIG. 9A illustrates a side view of the tab portion of the corner guard.

In an embodiment, the tab portion 10 is made from, for example, eighteen gauge spring steel, so as to provide proper tension on the body portion 2 while the device 1 is secured to the control table 100 (or "tool box"). The tab portion 10 may be partially secured within the body portion 2 (FIG. 6). In an embodiment, the tab portion 10 has a length 40 (FIG. 9A). The length 40 of the tab portion 10 may be great enough so that the tab portion 10 remains partially secured with in the interior of the main body section 2. In an embodiment, the main body section 2 may have a length 35 (FIG. 6). In an embodiment, the length 40 of the tab portion 10 is approximately five to twenty percent the length 35 of the main body section 2 so as to be long enough to provide support to the main body section 2 while not being too long so as to prevent the main body section 2 from slightly being able to be bent during installation and removal of the device 1 from the control table 100. In an embodiment, the length 35 of the main body section 2 may be altered by cutting (FIG. 4) a portion of the bottom 4 of the main body section 2 so as the device 1 may be used on a control table 100 having a smaller edge.

In an alternative embodiment, a perforation line 61 may be located near the bottom 4 of the main body section 2. The perforation line 61 may be located at a distance from the top 3 of the main body section 2 which corresponds to, for example, a common length 63 (FIG. 12) of a control table 100. As a result, a user may alter the overall length 35 of the main body section 2 by cutting the main body section 2 at, for example, the perforation line 61 and then reattaching a generally triangular cap 75 (FIG. 4) located at the bottom 4 of the main body section 2. The perforation line 61 may further allow a user to remove a portion of the bottom 4 of the main body 2 without the need for a saw or scissors. It should also be understood that the bottom 4 of the main body section 2 may also lack the preformation line 61 so as to increase stability of the device 1. In the embodiment wherein the preformation line 61 is not present, a user may use a standard table saw to cut the bottom 4 of the main body section 2 and then may reapply the generally triangular cap 75.

Figure 1:
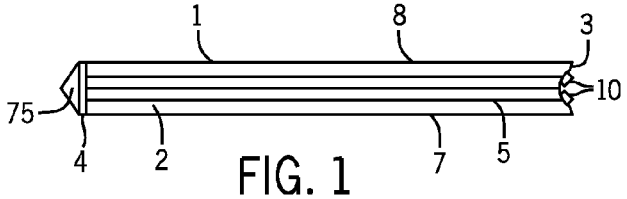
FIG. 1 illustrates a perspective view of the corner guard.
Figure 2:
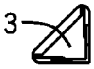
FIG. 2 illustrates a top view of the corner guard wherein the tabs are removed.
Figure 3:
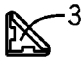
FIG. 3 illustrates a top view of the corner guard with the tabs secured.
Figure 4:
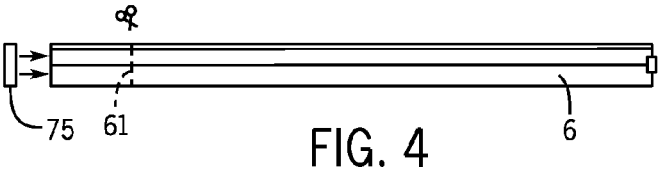
FIG. 4 illustrates a back view of the corner guard.
Figure 5A:
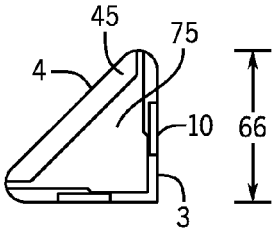
FIG. 5A illustrates a detailed view of the top of the corner guard without a tab.
Figure 5B:
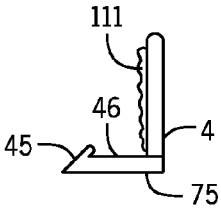
FIG. 5B illustrates a side view of the removable cap of the bottom of the corner guard.

Referring now to FIGS. 5A and 5B, in an embodiment, the removable triangular cap 75 may have an elevated ledge portion 45. The elevated ledge portion 45 may extend above a generally flat main body portion 46 of the removable triangular cap 75. The elevated ledge portion 45 may grasp the bottom of the control table or tool box 100 and may prevent the device 1 from slipping off the control table or tool box 100. Preferably, the elevated ledge 45 is angled inward at approximately forty-five degrees so as to better grasp the bottom of the control table or tool box 100.

Referring now to FIGS. 8-11, the tab portion 10 may have a head portion 23 and a skeleton portion 24. The head portion 23 may have a back 81, a top 82 and a front 83. The back 81 may be generally square-shaped and generally flat. The front 83 may be generally rectangular and generally flat. The back 81 and the front 83 may be largely parallel with respect to one another. The front 81 and the back 83 may be both connected to the top 82 portion; wherein the top 82 is substantially perpendicular with respect to the back 81 and the front 83. A distance 60 may separate the back 81 from the front 83. In an embodiment, the tab portion 10 is generally rigid so that the distance 60 between the back 81 and the front 83 remains largely constant.

Attached the back 81 of the tab portion 10 may be the skeleton portion 24. The skeleton portion 24 may have a plurality of extensions 50 extending out from a main shaft. FIGS. 8-11 illustrate eight extensions 50 extending from the main shaft; however, any number of extensions 50 may be used. In an embodiment, each extension 50 may have a top, a first side and a second side. The first side and the second side may be slightly slanted 95 downward. Further, in an embodiment, each extension 50 is substantially similar in size and shape. The extensions 50 may provide additional surface area to secure the tab portion 10 within the main body 2 of the device.

Figure 11:
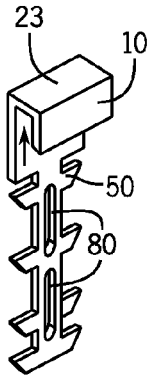
FIG. 11 illustrates a perspective view of the corner guard wherein the tensional forces are illustrated.
Figure 9B:
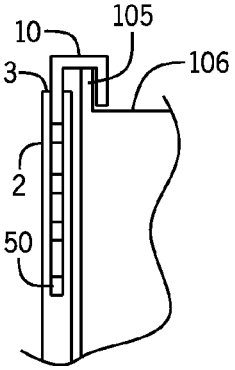
FIG. 9B illustrates a side cross sectional view of the corner guard secured to a control table edge.

In an embodiment, the back 81 of the tab portion 10 may have a plurality of openings 80 (FIG. 11). The openings 80 may receive an already formed protrusion (not illustrated) located within the interior of the main body portion 2 of the device 1 or the openings 80 may be inserted into the main body portion 2 while the main body portion 2 is being constructed so that melted plastic, rubber or the like of the main body section 2 fills in the openings 80 of the tab portion 10. As a result, the openings 80 allow the tab portion 10 to be further secured partially within the main body portion 2.

As stated above, in an embodiment, the skeleton portion 24 of the tab portion 10 may be concealed and may be located partially within the main body portion 2. More specifically, the skeleton portion 24 of the tab portion 10 may be partially located within the top 3 of the main body section 2 while the head portion (81, 82, 83) of the tab portion 10 extends beyond the top 3 of the main body section 2 and are visible.

Figure 7:
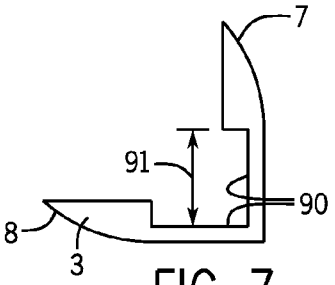
FIG. 7 illustrates a cross-sectional view of the center of the corner guard.
Figure 8:
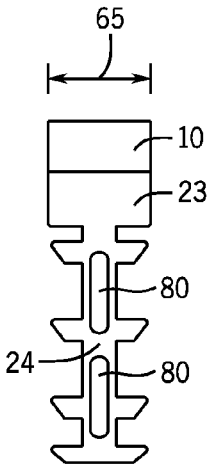
FIG. 8 illustrates an outline of the tab portion of the corner guard.

The top 3 of the main body section 2 may have a plurality of indentations 90 (FIG. 7). FIG. 7 illustrates two indentations 90 (one on the first side 7 and one on the second side 8 of the main body section 2). The indentations 90 may have a length 91 which is substantially equal to a length 65 (FIG. 8) of the head 23 of the tab portion 10 such that the head 23 of the tab portion 10 snugly fits partially within the indentation 90. Further, the length 65 of the head 23 of the tab portion 10 is approximately one-third the in overall length 66 (FIG. 5A) of a side of the top 3 of the main body 2 so as to better stabilize the tab portion 10 within the top 3 of the main body 2. Still further, in an embodiment, the head 23 of the tab portion 10 is secured in the center of the sides of the top 3 of the main body 2 to better stabilize the tab portion 10.

As stated above, the bottom 4 of the main body portion 2 may have a generally triangular cap 75. The generally triangular cap 75 may not only be more esthetically pleasing than an uncapped bottom 4 of the main body 2, but the generally triangular cap 75 may provide further support to the device 1 and may further partially secure the first side 7 of the device 1 to the second side 8 of the device 1. Still further, the generally triangular cap 75 may partially cover a sharp edge of the control table 100.

To use the device 1, a user may first align the bottom 4 of the main body section 2 to the bottom corner 101 (FIG. 12) of the control table 100. The generally triangular cap 75 may then be snapped into place (if not already secured to the bottom 4) at the bottom 4 of the main body section 2 so that the entire corner of the control table 100 is covered and protected. A user then aligns the main body 2 of the device 1 with the corner of the control table 100. The user then secures the front 83 of the head 23 of the tab portion 10 over a ridge 105 at the top 106 of the control table 100. As illustrated in FIG. 9A, the ridge 105 of the control table 100 may be placed partially within the space 60 between the back 81 and the front 83 of the head 23 of the tab portion 10. The device 1 may be secured onto the corner of the control table 100 by, for example, gravity or friction created by the head 23 of the tab portion 10. To remove device 1 from the control table 100 the reverse process is performed.

In alternative embodiments, the tab portion 10 and/or the main body portion 2 may be entirely or partially magnetic (having internal magnets 125) so as to be attracted to the control table 100. This further secures the device 1 to the control table 100. An adhesive (not shown) may also be used to further secure the device 1 to a control table 100. In yet another alternative embodiment, the tab portions 10 are magnetic and attracted to the corners of the control tables or tool boxes 100 and secures the corner guards 1 to the control table or tool box 100.

Finally, in an alternative embodiment, a removable hook 136 (FIG. 12) may be located on the exterior surface of the main body 2. The removable hook 136 is preferably located near the top 3 of the main body 2. The removable hook 136 allows a user to hang, for example, keys to open the control table or tool box 100, clothing, etc. As a result, by adding the corner guard 1 to a control table or tool box 100, a user may therein secure a storage hook to the corner of the control table or tool box 100 without damaging the control table or tool box 100. Of course, the device 1 may be utilized without the removable hook 136 by unscrewing the removable hook 136 from the inside surface of the device 1 or the device 1 may be sold without the removable hook 136.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

We claim:

1. A removable corner guard for a control table or a tool box, the removable corner guard comprising:

a generally elongated body having a top, a bottom, a front, a back, a first side, and a second side, wherein the generally elongated body has an L-shaped cross section and has a length;

an interior opening located at the top of the generally elongated body;

a generally triangular cap unit removably secured to the bottom of the generally elongated body;

a first tab secured to the top of the generally elongated body, the first tab having a top, a front, a back, and a skeleton portion extending downwardly from the back of the first tab, wherein the skeleton portion has a first side, a second side, a top, and a bottom;

wherein the top of the first tab has a first planar surface extending horizontally, wherein the front of the first tab has a second planar surface perpendicularly extending from the first planar surface of the top of the first tab, wherein a gap is created between the back of the first tab and the second planar surface of the front of the first tab, and wherein the back of the first tab is parallel to the second planar surface of the front of the first tab;

wherein a plurality of extended arm portions extends laterally outward from each of the first and second sides of the skeleton portion of the first tab and wherein the plurality of extended arm portions extending laterally outward from each of the first and second sides of the skeleton portion of the first tab is secured within the interior opening of the top of the generally elongated body; and wherein the first tab is configured to be secured to a top of the control table or the tool box and prevent the removable corner guard from moving with respect to the control table or the tool box.

2. The removable corner guard for the control table or the tool box of claim 1 further comprising:

a perforation line located at the bottom of the generally elongated body, wherein the perforation line allows the length of the generally elongated body to be altered by cutting the generally elongated body at the perforation line.

3. The removable corner guard for the control table or the tool box of claim 1, wherein the first tab is metal.

4. The removable corner guard for the control table or the tool box of claim 3, wherein the first tab is an eighteen gauge spring-steel tab.

5. The removable corner guard for the control table or the tool box of claim 1, wherein generally triangular cap unit is capable of grasping a portion of a bottom of the control table or the tool box and securing the generally elongated body to the control table or the tool box.

6. The removable corner guard for the control table or the tool box of claim 1, wherein the first tab is capable of being secured to the top of the control table or the tool box by gravity.

7. The removable corner guard for the control table or the tool box of claim 1, wherein the first tab is magnetic.

8. The removable corner guard for the control table or the tool box of claim 1, wherein an exterior surface of the generally elongated body has a glow-in-the-dark or fluorescent marking.

9. The removable corner guard for the control table or the tool box of claim 1 further comprising:

a removable hook secured to the first side or the second side of the generally elongated body, wherein the removable hook is configured to allow an item to be secured to the removable corner guard.

* * * * *